US010537191B2

(12) United States Patent
Ford et al.

(10) Patent No.: US 10,537,191 B2
(45) Date of Patent: Jan. 21, 2020

(54) ILLUMINATED SHELF SYSTEM WITH ELECTRICAL SUPPLY RAILS AFFIXED TO WALL PANEL

(71) Applicant: WALGREEN CO., Deerfield, IL (US)

(72) Inventors: Gerald Ford, Wauwatosa, WI (US); Paul McGivern, Milwaukee, WI (US)

(73) Assignee: WALGREEN CO., Deerfield, IL (US)

( * ) Notice: Subject to any disclaimer, the term of this patent is extended or adjusted under 35 U.S.C. 154(b) by 0 days.

(21) Appl. No.: 15/755,690

(22) PCT Filed: Aug. 26, 2016

(86) PCT No.: PCT/US2016/048869

§ 371 (c)(1),
(2) Date: Feb. 27, 2018

(87) PCT Pub. No.: WO2017/035429

PCT Pub. Date: Mar. 2, 2017

(65) Prior Publication Data

US 2018/0255944 A1 Sep. 13, 2018

Related U.S. Application Data

(60) Provisional application No. 62/210,826, filed on Aug. 27, 2015.

(51) Int. Cl.
*A47F 5/10* (2006.01)
*A47F 11/10* (2006.01)
(Continued)

(52) U.S. Cl.
CPC ..... *A47F 11/10* (2013.01); *A47F 5/0043* (2013.01); *A47F 5/103* (2013.01); *F21S 8/066* (2013.01);
(Continued)

(58) Field of Classification Search
CPC ..... H01R 25/147; H01R 25/14; F21V 21/34; F21V 21/35; A47F 5/10
See application file for complete search history.

(56) References Cited

U.S. PATENT DOCUMENTS 4,689,726 A * 8/1987 Kretzschmar ..... F21V 19/0085 362/127
4,747,025 A * 5/1988 Barton ..... A47F 5/0846 211/94.01
(Continued)

FOREIGN PATENT DOCUMENTS

| | | |
|---|---|---|
| CA | 2758626 A1 | 5/2013 |
| EP | 2768085 A1 | 8/2014 |
| GB | 2063586 A | 6/1981 |

OTHER PUBLICATIONS

International Application No. PCT/US2016/048869, International Search Report and Written Opinion, dated Oct. 6, 2016.
(Continued)

*Primary Examiner* — Ismael Negron
(74) *Attorney, Agent, or Firm* — Marshall, Gerstein & Borun LLP

(57) ABSTRACT

A shelf system includes first and second support rails, a wall panel disposed between the first and second support rails, first and second electrical supply rails disposed within a front surface of the wall panel and electrically insulated from the first and second support rails, a power supply electrically connected to the first and second supply rails, and at least one LED light fixture mounted on the first and second support rails, such that the light fixture is electrically connected with the first and second electrical supply rails to provide electrical current from the power source.

17 Claims, 11 Drawing Sheets

(51) Int. Cl.

| | |
|---|---|
| ***F21V 33/00*** | (2006.01) |
| ***F21S 8/06*** | (2006.01) |
| ***A47F 5/00*** | (2006.01) |
| *F21W 131/301* | (2006.01) |
| *F21Y 103/10* | (2016.01) |
| *F21Y 115/10* | (2016.01) |

(52) U.S. Cl.
CPC ... *F21V 33/0012* (2013.01); *F21W 2131/301* (2013.01); *F21Y 2103/10* (2016.08); *F21Y 2115/10* (2016.08)

(56) References Cited

U.S. PATENT DOCUMENTS 5,072,343 A * 12/1991 Buers ..... A47F 3/001 312/223.5
5,690,415 A * 11/1997 Krehl ..... A47F 5/101 108/23
5,695,261 A 12/1997 Slesinger et al.
6,042,244 A * 3/2000 Witkoski ..... A47F 5/0043 362/125
6,210,013 B1 * 4/2001 Bousfield ..... F25D 27/00 362/92
6,231,205 B1 * 5/2001 Slesinger ..... A47B 96/02 362/125
7,766,502 B2 * 8/2010 Tress ..... A47B 97/00 362/125
8,646,935 B2 * 2/2014 Karan ..... A47F 1/12 362/125
9,121,583 B2 * 9/2015 Takeuchi ..... A47F 11/10
9,130,327 B2 * 9/2015 Flynn ..... H01R 25/14
9,228,735 B2 * 1/2016 Liu ..... A47F 11/10
9,629,481 B2 * 4/2017 Karan ..... A47F 1/12
2014/0055987 A1 2/2014 Lindblom et al.
2014/0370730 A1 12/2014 Flynn et al.
2015/0092397 A1 4/2015 Liu
2015/0201762 A1 7/2015 Walter

OTHER PUBLICATIONS

International Application No. PCT/US2016/048869, International Preliminary Report on Patentability, dated Feb. 27, 2018.

* cited by examiner

ILLUMINATED SHELF SYSTEM WITH ELECTRICAL SUPPLY RAILS AFFIXED TO WALL PANEL

CROSS-REFERENCE TO RELATED APPLICATIONS

This application claims priority to U.S. provisional application Ser. No. 62/210,826, filed Aug. 27, 2015, the entire contents of which are both incorporated by reference.

BACKGROUND OF THE INVENTION

Technical Field

The present invention relates to an illuminated retail shelf system and more particularly to a variable configuration retail shelf system that includes integrated low voltage illumination.

Background of the Invention

Typically, retail stores often display products for sale on non-illuminated shelf systems. Often these shelf systems are configurable to accommodate various size products and product displays. For example, traditional peg board and shelf gondolas allow individual shelves to be placed a various locations, e.g., heights, relative to the hack wall. Alternatively, the traditional shelf systems may accommodate customized shelves configured to accommodate the display of particular packaging, for example cosmetic products, soup cans, clam shell packaging, etc.

Advancements in the area of retail shelving have recently included the integration of low-cost illumination directly into shelves by way of LED lighting. However, prior attempts to integrate LED lighting into retail shelves have focused on the electrification of the shelves' metal support structure. However, integrating electrical conduction directly into the shelf support structure results in various undesirable side effects, including but not limited to the increased cost of repair to damaged LED lighting as well as the need to form the shelf support structures from electrically conductive materials such as metal, rather than more cost effective alternatives. Furthermore, electrification of the shelf support structures often prohibits adjacent shelves from utilizing a common support structure, due to the resultant short that would be formed in the electrical circuit.

The present invention seeks to improve upon the prior art by providing a configurable retail shelf that provides product LED shelf illumination through a discrete electrical pathway.

SUMMARY OF THE INVENTION

In accordance with an embodiment of the present invention, an illuminated shelf system is provided including, a first support rail, a second support rail, a wall panel disposed between the first support rail and second support rail, a first electrical supply rail and second electrical supply rail affixed to the wall panel and insulated from the first support rail and second support rail, at least one fixture removably mounted to the first support rail and second support rail, an array of light emitting diodes disposed within the at least one fixture, wherein a first end of the array of light emitting diodes is in removable electrical contact with the first electrical supply rail and wherein a second end of the array of light emitting diodes is in removable electrical contact with the second electrical supply rail, and a power supply in electrical contact with the first electrical supply rail and second electrical supply rail as to define an electrical circuit and configured to provide an electrical current to the array of light emitting diodes when the least one fixture is mounted to the first support rail and second support rail.

In accordance with an aspect of the present invention, a portion of the first and second electrical supply rails extend outwardly from the front surface of the wall panel.

In accordance with another aspect of the present invention, the at least one fixture of the illuminated shelf system includes a first resilient electrical contact surface that is in electrical contact with the first end of the light emitting diode array and configured to form an electrical connection with the first electrical supply rail, and wherein the at least one fixture includes a second resilient electrical contact surface that is in electrical contact with the second end of the light emitting diode array and configured to form an electrical connection with the second electrical supply rail.

In accordance with another aspect of the present invention, the at least one fixture of the illuminated shelf system is a low voltage system having an electrical current that is less than or equal to approximately 24 volts.

In accordance with another aspect of the present invention, the illuminated shelf system may include a third support rail and a second wall panel disposed between the second support rail and third support rail.

In accordance with another aspect of the present invention, the illuminated shelf system may include a fourth support rail and a third wall panel disposed between the third support and fourth support rail.

In accordance with another aspect of the present invention, the support rails of the illuminated shelf system may include a plurality of slots, wherein each slot is configured to receive at least a portion of a first fixture and second fixture therein.

Further aspects or embodiments of the present invention will become apparent from the ensuing description which is given by way of example only.

BRIEF DESCRIPTION OF THE DRAWINGS

A clear conception of the advantages and features constituting the present invention will become more readily apparent by referring to the exemplary, and therefore non-limiting, embodiments illustrated in the drawings accompanying and forming a part of this specification, wherein like reference numerals designate the same elements in the several views.

In the drawings.

Figure 1:
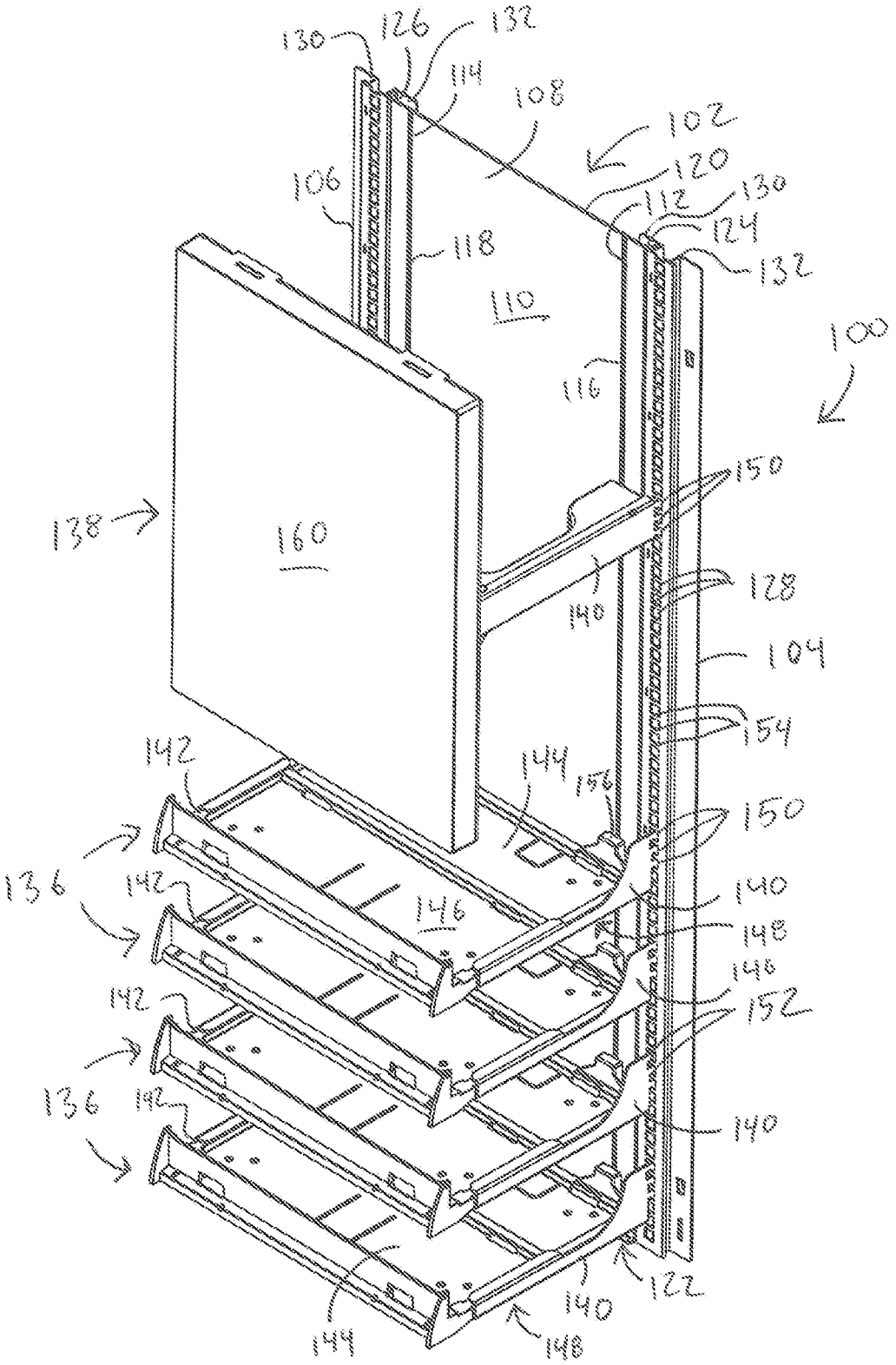
FIG. 1 is a front isometric view of the illuminated, shelf system including fixtures according to one embodiment of the present invention.
Figure 2:
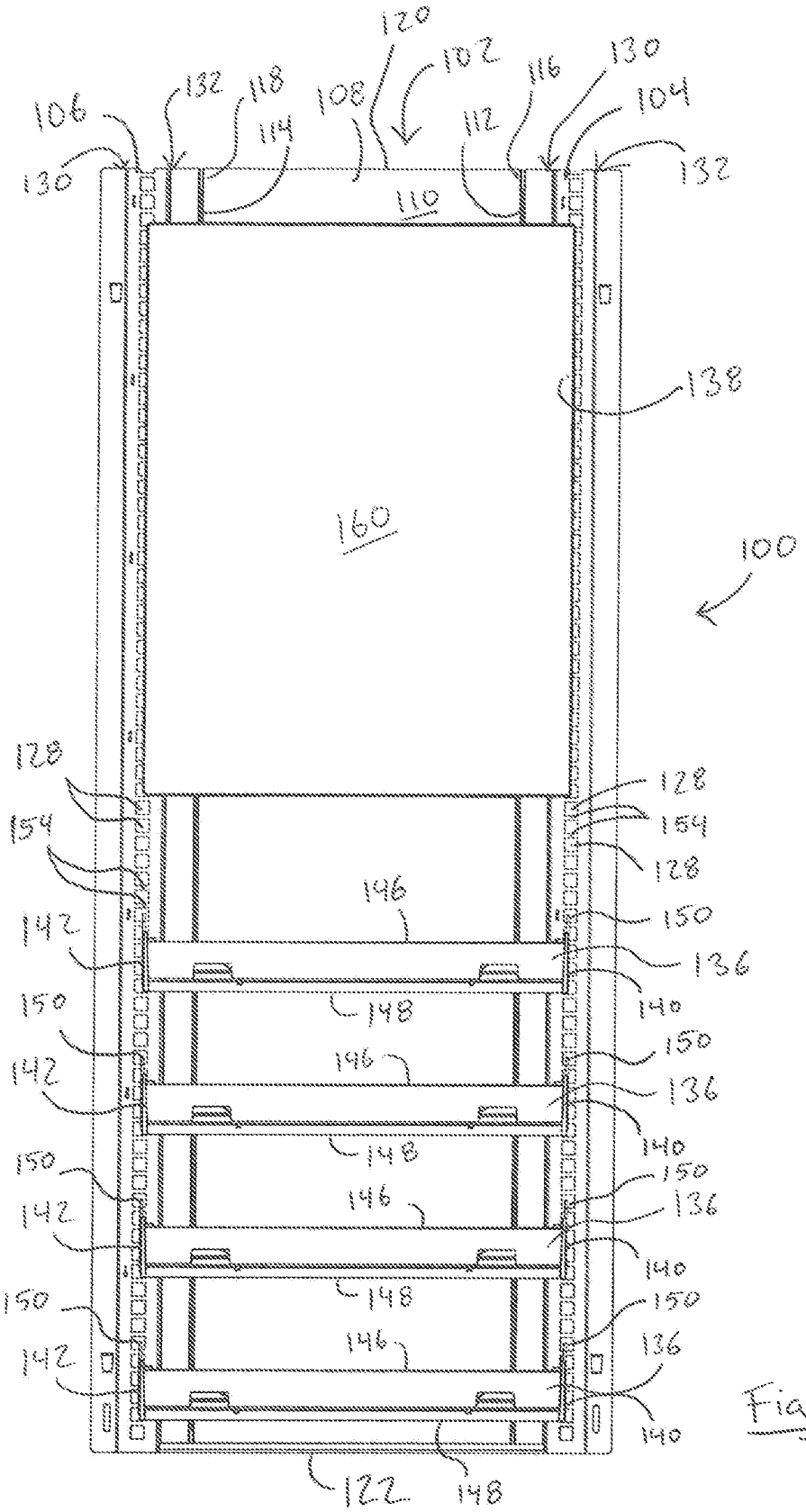
FIG. 2 is a front elevation view of the illuminated shelf system including fixtures of the present invention shown in FIG. 1.

In describing the representative embodiments of the invention illustrated in the drawings, specific terminology will be resorted to for the sake of clarity. However, it is not intended that the invention be limited to the specific terms so selected and it is to be understand that each specific term includes all technical equivalents which operate in a similar manner to accomplish a similar purpose.

DETAILED DESCRIPTION OF THE DRAWINGS

The present invention and the various features and advantageous details thereof are explained more fully with reference to the non-limiting embodiments described in detail in the following description.

Turning now to FIGS. 1-11, and initially FIG. 1, there is shown one embodiment of the shelf system 100 in accordance with the present invention including a single wall segment 102. The single wall segment 102 of the shelf system 100 includes a first support rail 104 and a second support rail 106. However, as will be described in further detail below, it is considered well within the scope of this invention that the shelf system 100 may include a plurality of wall segments 102, in which case the plurality of wall segments 102 will include more than two support rails. The shelf system 100 of the present invention is configured to engage, e.g., hang on, a preexisting retail shelf support (not shown), such as an in-store gondola or wall mounted bracket.

Still referring to FIG. 1, a wall panel 108 is disposed between opposing support rails 104, 106. The watt panel 108 is formed of a nonconductive material such as plastic and may be formed by any conventional method of shaping and forming nonconductive materials such as injection molding or extrusion. The wall panel 108 may be mechanically or adhesively affixed to the support rails 104, 106 in accordance with any conventional method known in the art. Alternatively, the wall panel 108 may be retained between the opposing support rails 104, 106 by frictional engagement therewith. Moreover, in an embodiment of the invention in which the shelf support system 100 includes a plurality of wall segments 102, each support rail 104, 106 may engage or be affixed between two wall panels 108 as described in further detail below. Disposed within the outer facing or front surface 110 of the wall panel 108 is a first electrical supply rail 112 and a second electrical supply rail 114. The first electrical supply rail 112 and the second electrical supply rail 114 are configured to receive electrical power from a power source (not shown). In one embodiment of the present invention the power source is a low voltage power source, such as a 24 volt power converter configured to illuminate various light emitting diodes in an array of light emitting diodes. The first and second electrical supply rails 112, 114 may be affixed to the front surface 110 of the wall panel 108 by means of being at least partially disposed within corresponding retaining channels 116, 118 located wall panel 118. That is to say that the front surface 110 of the wall panel 118 may include a first retaining channel 116 and second retaining channel 118, which extend substantially along a vertical length of the wall panel 118, from the top edge 120 of the wall panel 108 to the bottom edge 122 of the wall panel 108. The first retaining channel 116 is located at a distance from the first side edge 124 of the wall panel 108, while the second retaining channel 118 is located at a distance from the second side edge 126 of the wall panel 108. As shown in FIG. 1, by way of locating the first and second retaining channels 116, 118 at a distance, i.e., removed from, the corresponding side edges 124, 126 of the wall panel 108, the first and second electrical supply rails 112, 114 are removed and electrically insulated from the first and second support rails 104, 106. The first and second retaining channels 116, 118 may have a depth sufficient to received and retain at least a portion of the corresponding first and second electrical supply rails 112, 114 within the retaining channels 116, 118, respectively. By way of receiving only a portion of the first and second electrical supply rails 112, 114 within the retaining channels 116, 118, respectively, a portion of the first and second electrical supply rails 112, 114 may be configured to extend outwardly beyond the font surface 110 of the wall panel 108, as to facilitate their electrical contact with the fixtures as will be described in further detail below.

In one alternative embodiment of the present invention, the first and second power supply rails 112, 114 may be affixed to the wall panels 108 in accordance with any other method known in the art, such as adhesive, rivets or fasteners.

Still referring to FIG. 1, each support rail 104, 106 includes a plurality of slots 128 extending along a longitudinal axis of the support rail 106. The slots 128 are configured to engage and structurally support a portion of the shelf fixtures, as will be described in detail below. As shown in FIG. 1, the plurality of slots 128 are configured to be substantially coplanar with the front surface 110 of the wall panel 108 when the shelf system 100 is assembled. In this configuration, the wall panel 108 and support rails 104, 106 provide a continuous or substantially uninterrupted aesthetic appearance to the shelf system 100. Adjacent the plurality of slots 108, each support rail 104, 106, further comprises a first side edge retaining slot 130 and a second side edge retaining slot 132. The first side edge retaining slot 130 is configured to receive and retain therein the first side edge 124 of the wall panel 108, while the second side edge retaining slot 132 is configured to receive and retain therein the second side edge 126 of the wall panel 108. As shown in single wall segment 102 of FIG. 1, the second side edge retaining slot 132 of the first support rail 104 and the first side edge retaining slot 130 of the second support rail 106 are empty. In alternative embodiments of the present invention that include a plurality of wall segments 102, these side edge retaining slots 130, 132 would receive corresponding porting of the adjacent wall panels 102. Alternatively, where a supporting rail 104, 106 defines the side edge of the shelf system 100, that supporting rail 104, 106 may only include one of the side edge retaining slots 130, 132.

Still referring to FIG. 1, the side edge retaining slots 130, 132 are configured to slightly overlap with a portion of the side edges 124, 126 of the wall panel 108. Accordingly, to ensure that the electrical supply rails 112, 114 are electrically insulated from the support rails 104, 106, the distance between the electrical supply rails 112, 114 and the corresponding first and second edge side edge 124, 126 of the wall panel 108 may be greater than the distance of overlap between the side edge retaining slots 130, 132 and the wall panel 108. That is to say that the electrical supply rails 112, 114 are removed a distance from the side edge retaining slots 130, 132 of the supporting rails 104, 106.

Still referring to FIG. 1, a plurality of shelf fixtures 136 and one light box fixture 138 are shown structurally supported by support rails 104, 106. However any combination of fixtures, including but not limited to shelf fixtures 136 and light box fixtures 138 are considered within the scope of this invention. Additionally, the shelf system 100 is configured to support non-illuminated or non-electrified fixtures either in combination with electrified shelf fixtures 338 and light box fixtures 339, or independent thereof.

While the following discussion is provided in reference to the shelf fixture 136, it equally applies to the light box fixture 138. In one embodiment, the shelf fixture 136 includes a first arm 140 and second arm 142 and a shelf base 144 disposed between the arms 140, 142. The shelf base 144 has a top surface 146 that is configured to receive products for display thereon, and a bottom surface 148 located underneath the shelf base 144. Each arm 140, 142 includes a plurality of tabs 150 extending perpendicular relative to the length of the arms 140, 142. The tabs 150 are removed, i.e. extend, a distance from the end of the arms 140, 142 to form a receiving area 152 between each tab 150 and the end of the respective arm 140, 142. When mounted on the shelf system 000 as seen in FIG. 1, one or more of the tabs 150 from each arm 140, 142 are inserted into a slot 128 in the corresponding support rail 104, 106. The shelf fixture 136 is then pressed downward, such that a horizontal member 154, which divides the adjacent slots 128 on the support rails 104, 106 is received within the receiving area 152 and both the tabs 150 and the end of the corresponding arm 140, 142 engage opposing sides of the horizontal member 154. In this mounted configuration the shelf fixture 136 is now structurally supported on the support rail 104, 106, independently of the wall panel 108.

Figure 11:
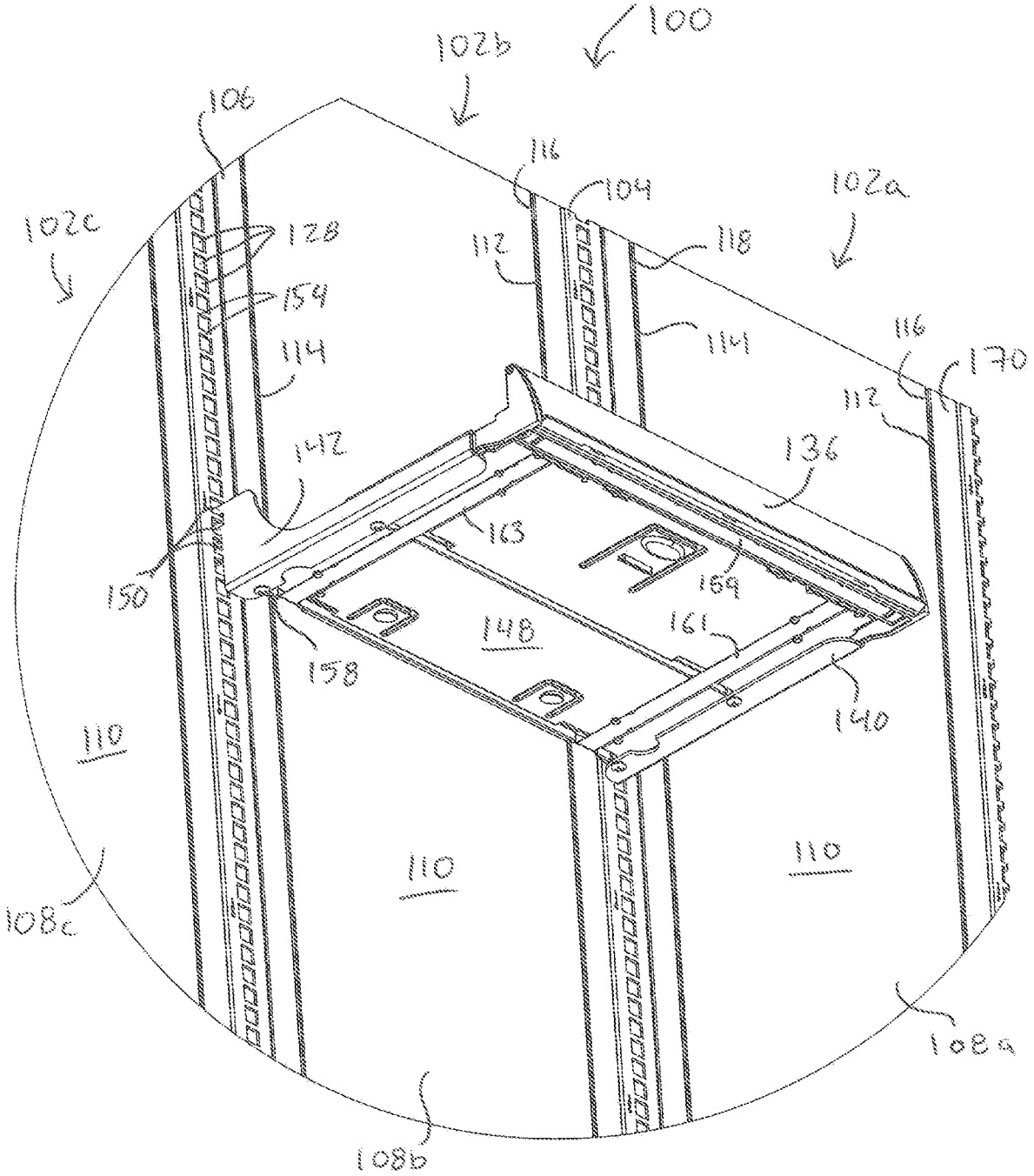
FIG. 11 is a detailed bottom front perspective view showing the bottom of a fixture that is engaging the illuminated shelf system of the present invention shown in FIG. 5.

As will be described in further detail below, in this mounted configuration, as shown in FIG. 1, the first power supply rail 112 comes into electrical contact with a first resilient electrical contact surface 156 of the shelf fixture 136 while the second power supply rail 114 comes into electrical contact with a second resilient electrical contact surface 158 of the shelf fixture 136. The first and second resilient electrical contact surfaces 156, 158 are each electrically affixed to opposing ends of an array of light emitting diodes 159, shown in FIG. 11, by way of conductors 161, 163 such as wires or electrically conductive strips that as also shown in FIG. 11. Accordingly, when the shelf fixture 136 is mounted on the support rails 104, 106 and the shelf fixture 136 is pushed back into its display position an electrical circuit is formed in which an electrical current that is provided by the power supply (not shown), travels from the power supply through the first electrical supply rail 112, first resilient electrical contact surface 156, the first conductor 16, and the LED array 159, and then back through the opposing second conductor 163, second resilient electrical contact surface 158, and second electrical supply rail 114. In one embodiment of the present invention, a plurality of shelves 136 and/or light box fixtures 138 are configured to be mounted to and illuminated by the shelf system 300 simultaneously.

As was indicated above, the light box fixture 138 is generally similar to the structure of the shelf fixture 136 as previously described, and also includes a first arm 140 and second arm 140. However, the light box fixture 138 differs in that rather than having a shelf surface 144, the light box fixture 138 has an outwardly facing illumination panel 160, which is generally configured to be oriented parallel to the outer surface 110 of the wall panel 108. The illumination panel 160 is further configured to optionally receive or retain backlit graphic, advertising material, instructional material or other printed matter to a consumer. As with the previously described shelf fixture 136, each arm 140, 142 of the light box fixture 138 includes a plurality of tabs 150 extending perpendicular relative to the length of the arms 140, 142. The tabs 150 are removed a distance from the end of the arms 140, 142 to form a receiving area 152 between each tab 150 and the end of the respective arm 140, 142. When mounted on the shelf system 100 as seen to FIG. 1, one or more of the tabs 150 from each arm 140, 142 are inserted into a slot 128 in the corresponding support rail 104, 106. The light box fixture 138 is then pressed down, such that a horizontal member 154, which divides the adjacent slots 128 on the support rails 104, 106 is received within the receiving area 152 and both the tabs 150 and the end of the corresponding arm 140, 142 engage opposing sides of the horizontal member 154. In this mounted configuration the light box fixture 138 is no structurally supported on the support rail 104, 106, independently of the wall panel 108.

In this mounted configuration, as shown in FIG. 1, the first power supply rail 112 comes into electrical contact with the first resilient electrical contact surface 156 of the shelf fixture 136 while the second power supply rail 114 comes into electrical contact with a second resilient electrical contact surface 158 of the light box fixture 138. The first and second resilient electrical contact surfaces 156, 158 are each electrically affixed to opposing ends of an array of light emitting diodes (not shown) by way of conductors such as wires or electrically conductive strips. In the light box fixture 138, the LED array may be positioned about the outwardly facing illumination panel 160 of the light box fixture 138, rather than in a single line of LEDs such that the entire surface of the outwardly facing illumination panel 160 is illuminated. The light box fixture 138 may also include a lens or diffuser located between the LED array and the outwardly facing illumination panel 160, such that the light omitted from the LED array is modified to better suit the particular printed matter that may be displayed within the light box fixture 138. When the light box fixture 138 is mounted on the support rails 104, 106 and the light box fixture 138 is pushed back into its display position an electrical circuit is formed in which an electrical current that is provided by the power supply (not shown), travels from the power supply through the first electrical supply rail 112, first resilient electrical contact surface 156, and the LED array, and then back through the opposing second resilient electrical contact surface 158, and second electrical supply rail 114. As was previously stated, in one embodiment of the present invention a plurality of illuminated fixtures, including shelf fixtures 136 and/or light box fixtures 138 are configured to be mounted to and illuminated by the shelf system 100 simultaneously.

Figure 3:
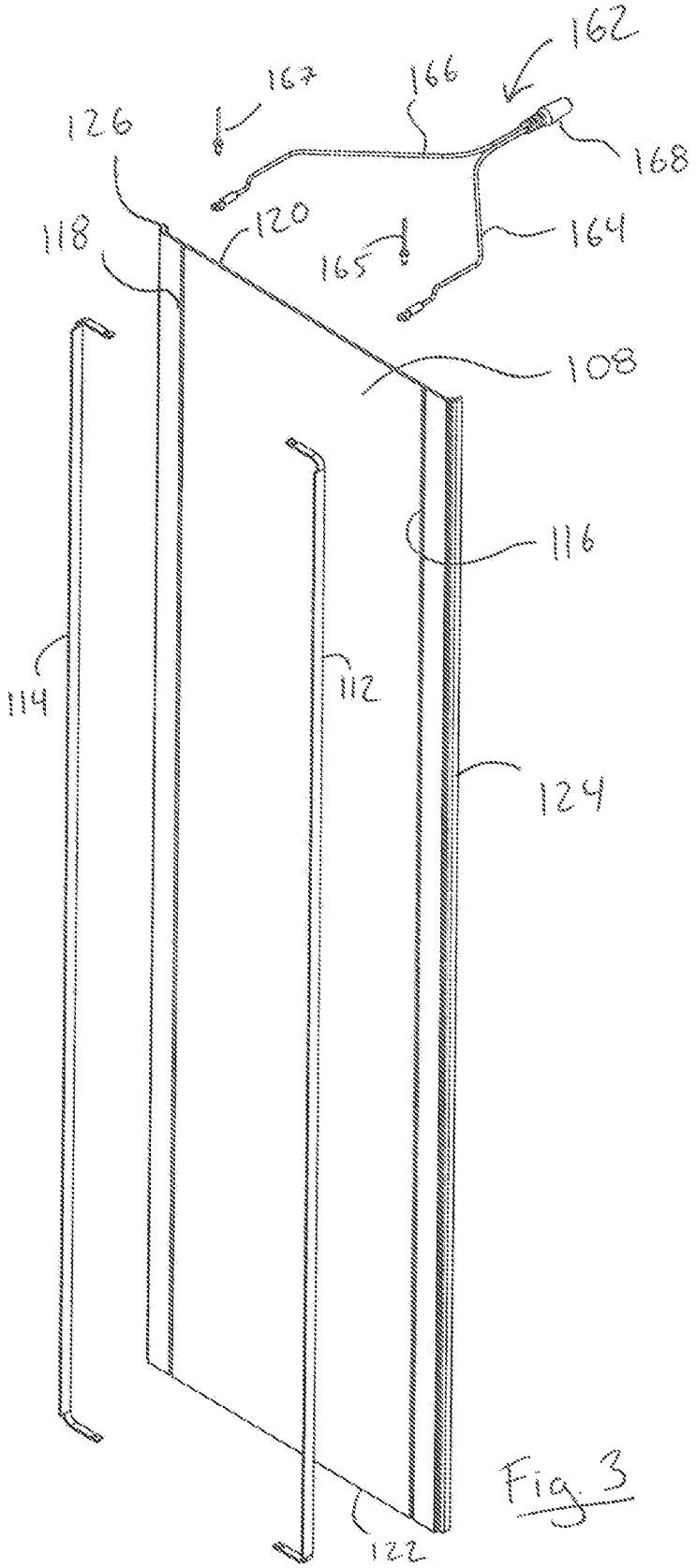
FIG. 3 is an exploded front isometric view of a portion of the illuminated shelf system of the present invention shown in FIG. 1.
Figure 4:
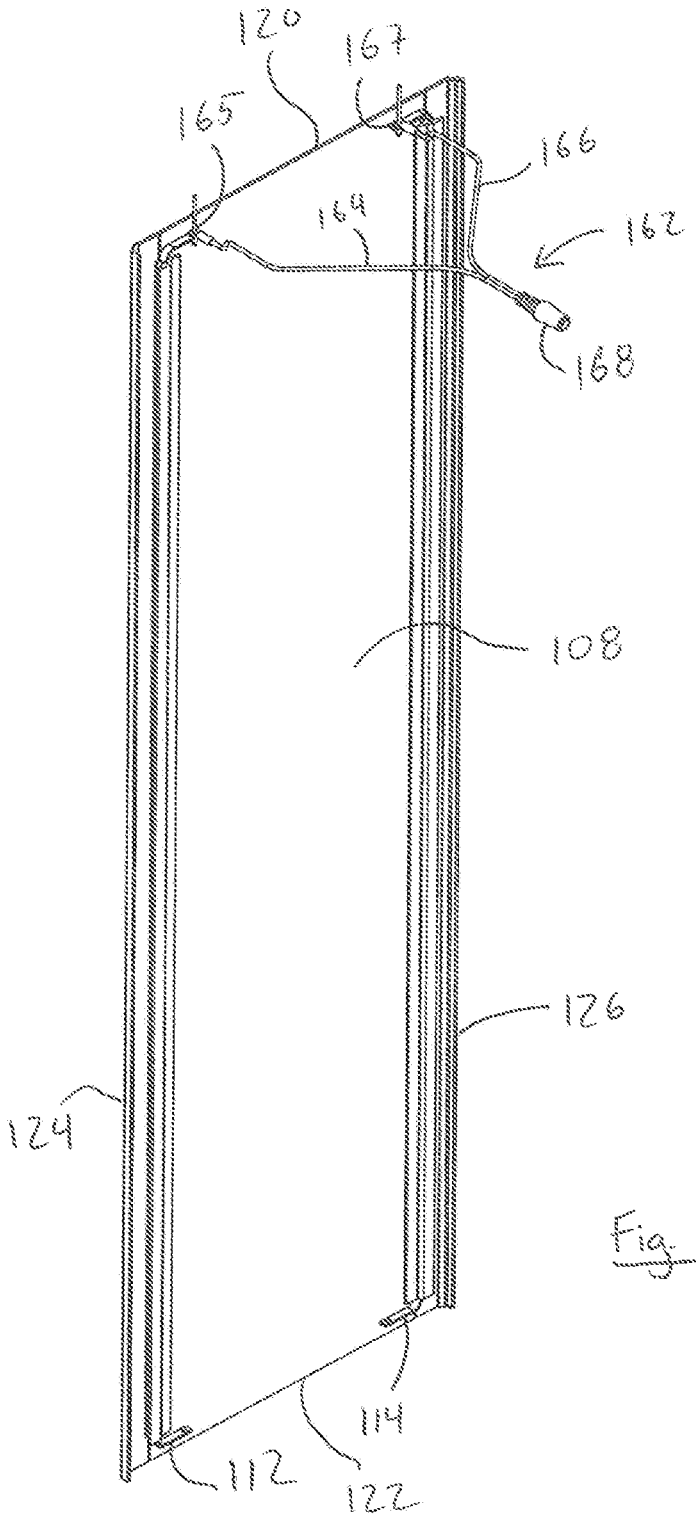
FIG. 4 is a rear isometric view of a portion of the illuminated shelf system of the present invention shown in FIG. 1.

Turning now to FIGS. 3 and 4, in which the wall panel 108 of the single wall segment 102 is shown, electrical connector 162 is provided. The electrical connector 162 includes a first conductor 164 in electrical connection with the first electrical supply rail 112 and a second conductor 166 in electrical connection with the second electrical supply rail 114. The first conductor 164 may be affixed to the top of the first electrical supply rail 112 via a fastener 165, while the second conductor 166 may similarly be affixed to the top of the second electrical supply rail 114 via a fastener 167. A socket 168 is disposed at one end of the electrical connector 162, and is configured to form an electrical contact between the conductors 164, 166 and the power source snot shown). In one embodiment of the present invention the power source is a low voltage power source, such as a 24 volt power converter configured to illuminate low voltage LED arrays.

Figure 5:
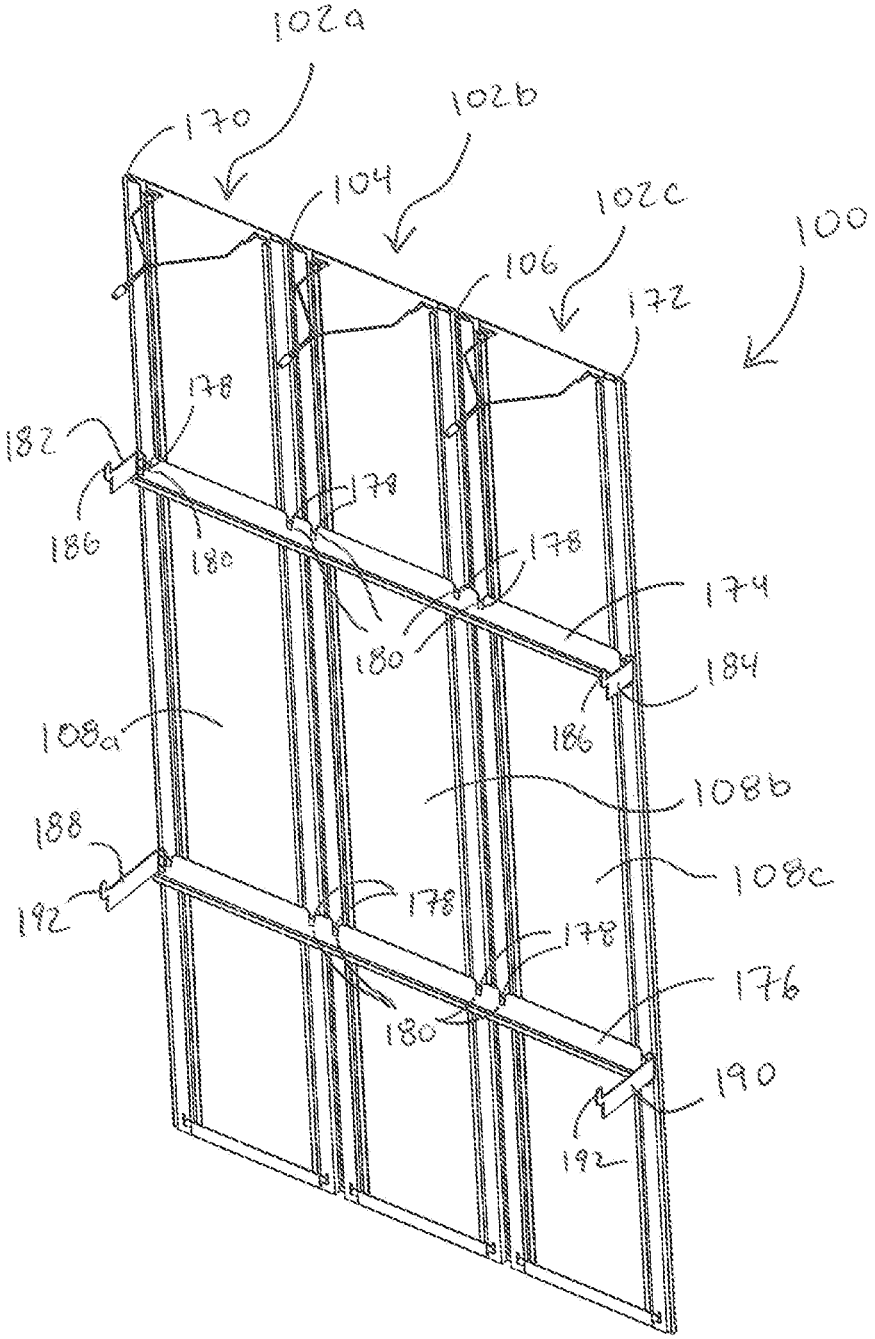
FIG. 5 is a rear isometric view of the illuminated shelf system in accordance with one alternative embodiment of the present invention including a plurality of wall segments.

Turning now to FIGS. 5-11, and initially FIG. 5, the shelf system 100 is shown in an alternative configuration including a plurality of wall segments 102*a*, 102*b*, 102*c*. That is to say that a plurality of wall panels 108*a*, 108*b*, 108*c* are mounted in a side-by-side fashion. In this configuration, adjacent wall panels 108 are connected to one another by way of a shared support rail 104, 106, 170, 172, where support rails 104 and 106 are located between support rails 170 and 172. Support rail 170 is a first end support rail, and as such defines a first edge of the shelf system 100 including a plurality of wall segments 102*a*, 102*b*, 102*c*. To this end, as was previously stated above, the support rail 170 includes only one side edge retaining slot 130 configured to receive a first side edge 124 of a wall panel 108*a*. Similarly, opposing support rail 172 is a second end support rail, and as such defines a second edge of the shelf system 100 including a plurality of wall segments 102*a*, 102*b*, 102*c*. To this end, as was previously stated above, the support rail 172 includes only one side edge retaining slot 132 configured to receive a second side edge 126 of a wall panel 108*c*.

Still referring to FIG. 5, in which the hack surfaces of the wall panels 108*a*, 108*b*, 108*c* of the plurality of wall segments 102*a*, 102*b*, 102*c* are shown, two crossbars 174, 176 are configured to engage, e.g., hang on, a preexisting retail shelf support (not shown), such as an in-store gondola or wall mounted bracket. A first crossbar 174 extends along a length of the plurality of wall segments 102*a*, 102*b*, 102*c*, such that receiving tabs 178 extending rearwardly of the support rail 104, 106, 170, 172 are received within slots 180 along the length of the first crossbar 174. In this configuration the first crossbar 174 provides structural support for each of the support rails 104, 106, 170, 172 and their corresponding wall segments 102*a*, 102*h*, 102*c*. A first arm 182 extends from and rearwardly of the first crossbar 174 at an end adjacent the support rail 170, while an opposing second arm 184 extends from and rearwardly of the first crossbar 174 at an end adjacent the support rail 172. One or more tabs 186 extending from the first and second arms 182, 184 are configured to engage the preexisting retail shelf support (not shown), such as an in-store gondola or wall mounted bracket.

Similarly, the second crossbar 176 extends along the length of the plurality of wall segments 102*a*, 102*b*, 102*c* such that the receiving tabs 178 extending rearwardly of the support rail 104, 106, 170, 172 are received within slots 180 along the length of the second crossbar 176. In this configuration the second crossbar 176 provides structural support for each of the support rails 104, 106, 170, 172 and their corresponding wall segments 102*a*, 102*b*, 102*c*. A first arm 188 extends from and rearwardly of the second crossbar 176 at an end adjacent the support rail 170, while an opposing second arm 190 extends from and rearwardly of the second crossbar 176 at an end adjacent the support rail 172. One or more tabs 192 extending from the first and second arms 182, 184 are configured to engage the preexisting retail shelf support (not shown), such as an in-store gondola or wall mounted bracket.

Figure 6:
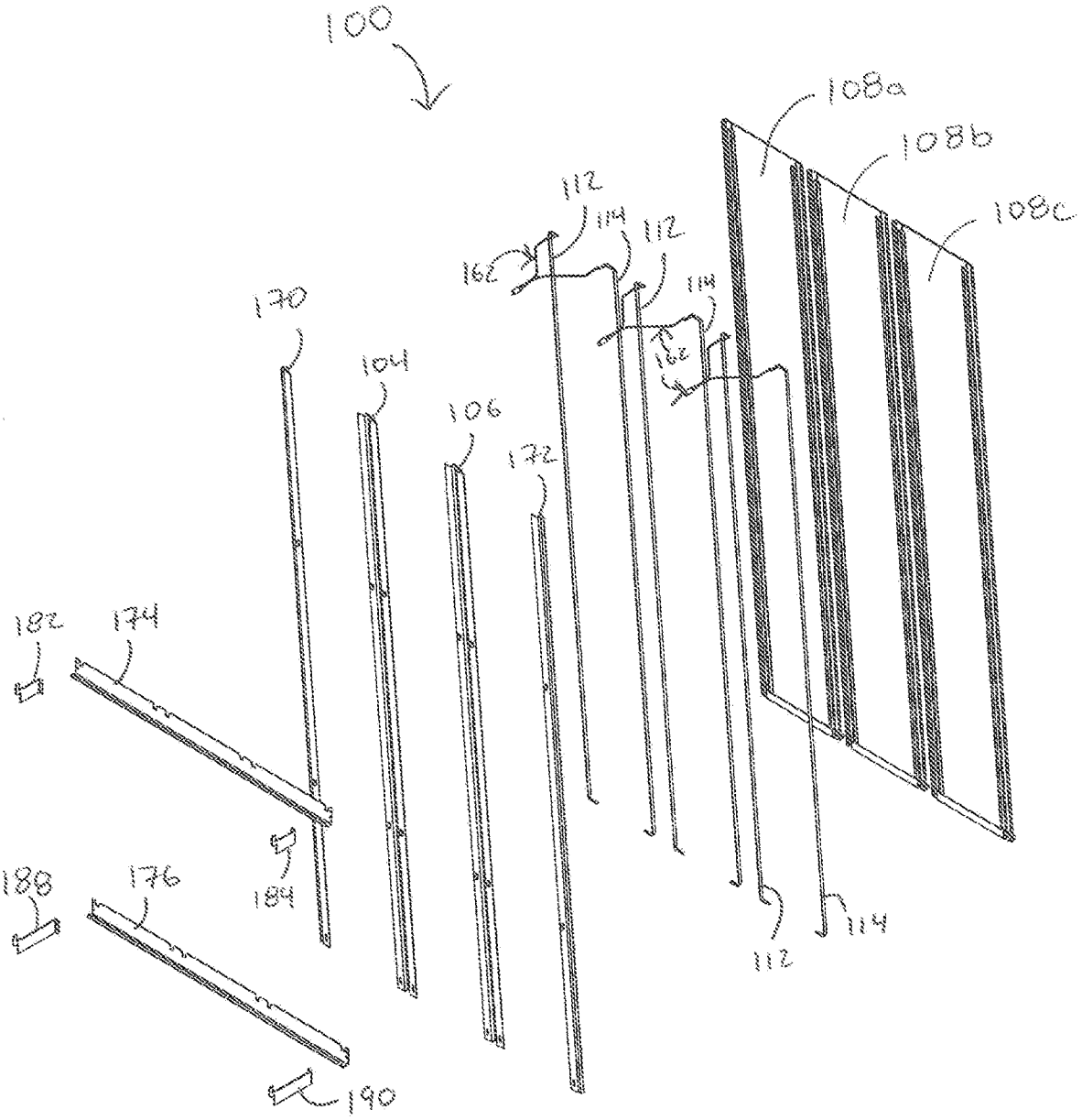
FIG. 6 is a rear isometric exploded of the illuminated shelf system of the present invention shown in FIG. 5.
Figure 7:
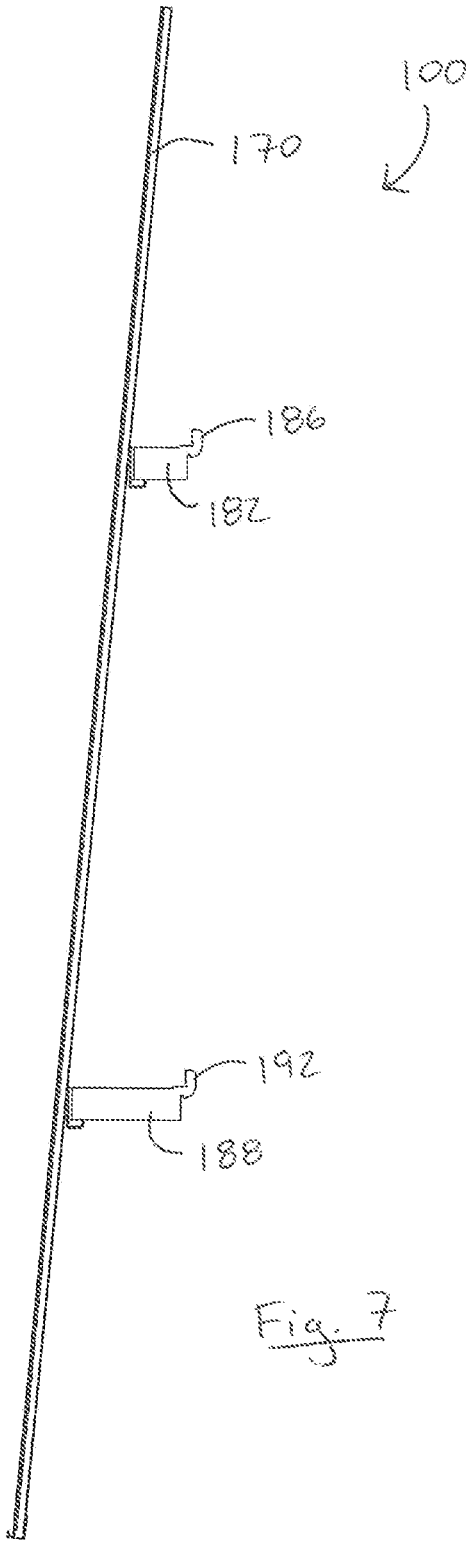
FIG. 7 is a side elevation view of the illuminated shelf system of the present invention shown in FIG. 5.
Figure 8:
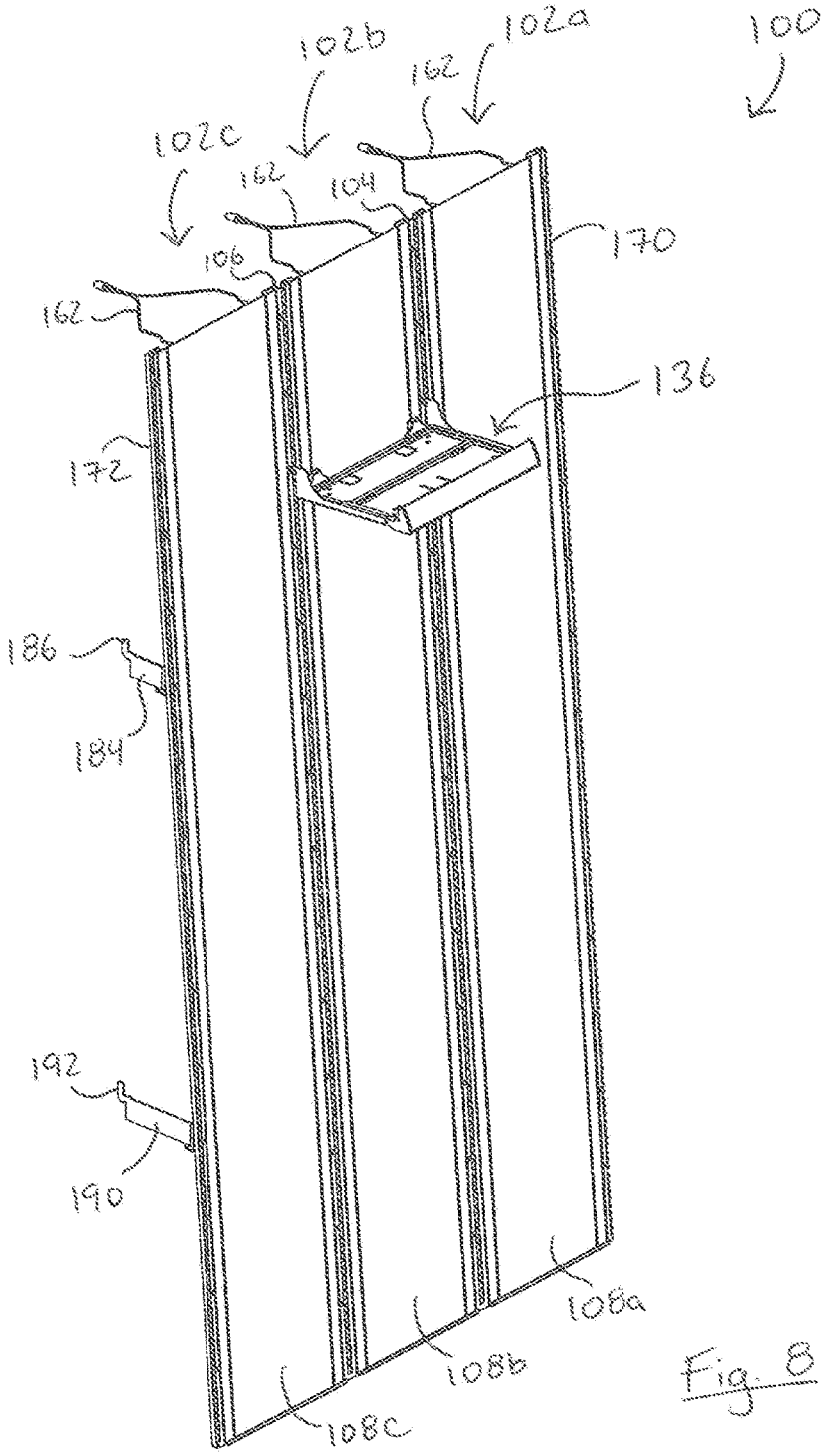
FIG. 8 is a front perspective view of the illuminated shelf system including a fixture of the present invention shown in FIG. 5.
Figure 9:
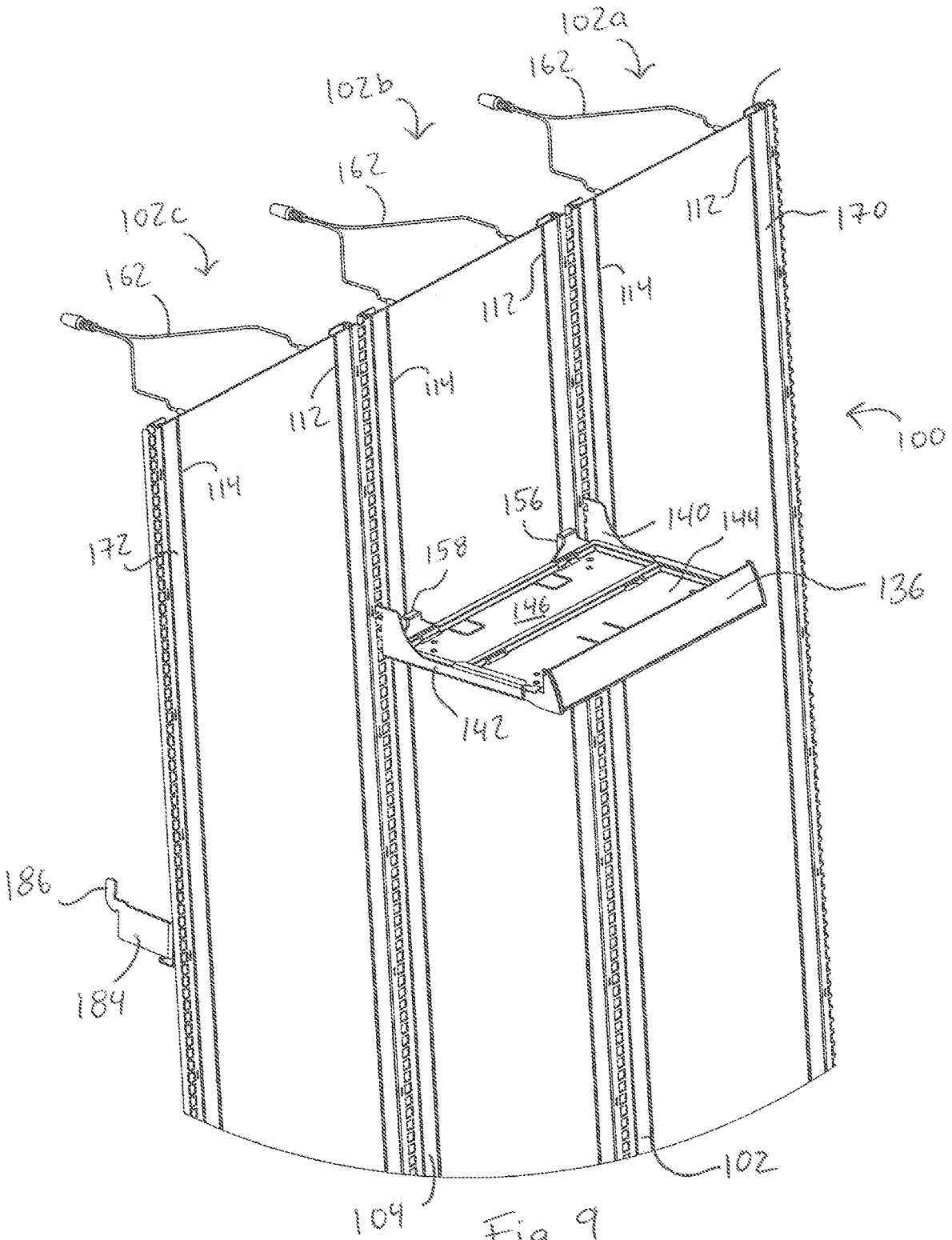
FIG. 9 is a detailed op front perspective view of the illuminated shelf system including a fixture of the present invention shown in FIG. 5.
Figure 10:
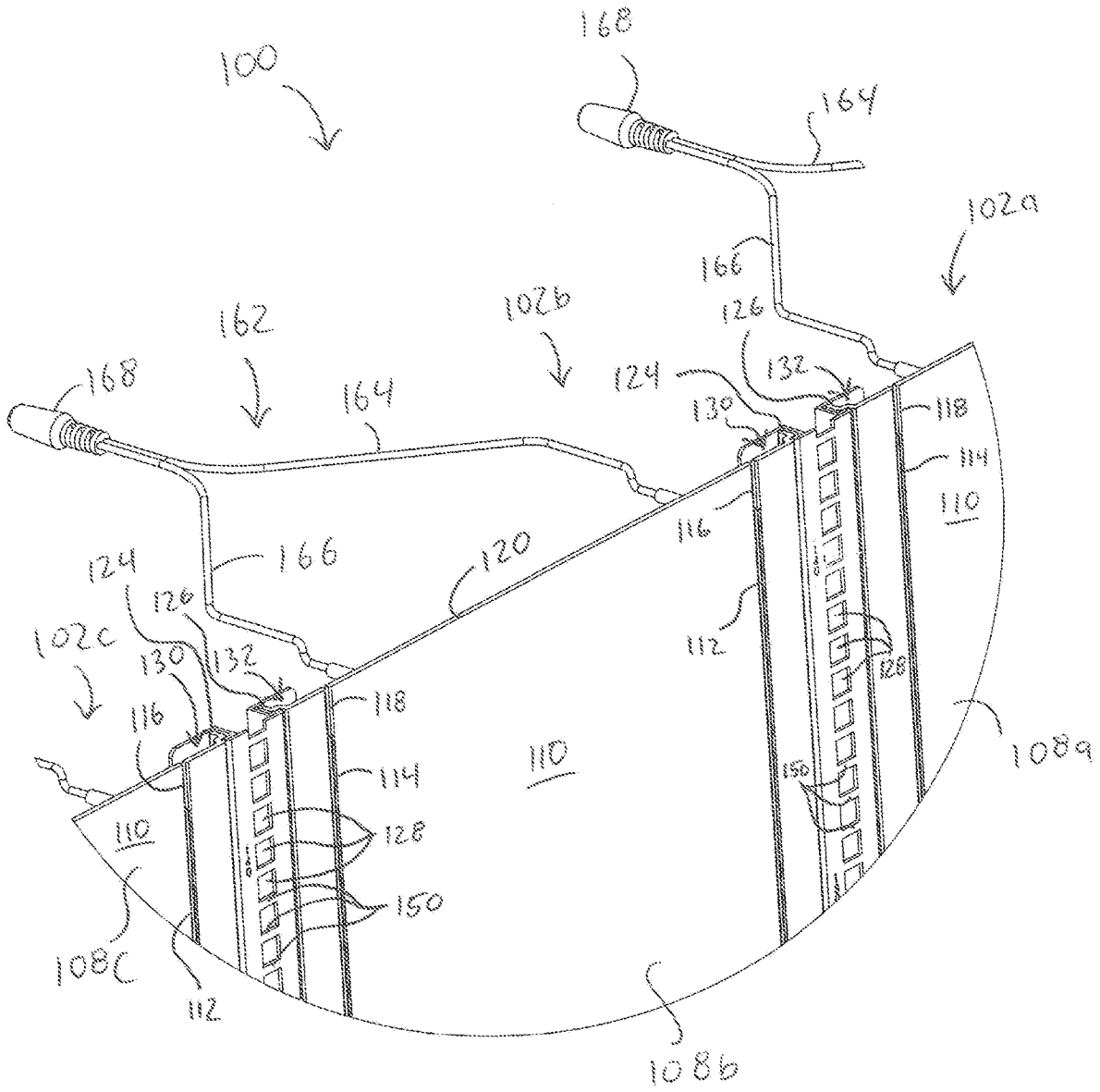
FIG. 10 is a detailed front perspective view of the illuminated shelf system of the present invention shown in FIG. 5.

Additionally, as shown in FIGS. 5-7, the first and second arms 182, 184 of the first crossbar 174 may have a length less than the first and second arms 188, 190 of the second crossbar 176. As a result of the differing length of arias 182, 184 relative to arms 188, 190 the general angle of the shelf system 100 may differ relative to the angle of the preexisting retail shelf support (not shown), such as an in-store gondola or wall mounted bracket. That is to say that the lower portion of the shelf system 100 will be located further from the preexisting retail shelf support when the length of arms 182, 184 is less than the length of arms 188, 190, as shown in FIGS. 5-7. However, the present invention is in no way limited to this relative angle of the arms 182, 184, 188, 190, and alternative arm lengths and corresponding angles of the shelf system 100 are considered well within the scope of the invention. Furthermore, the present invention is not limited as to the number of crossbars, and any number of crossbars may be considered within the scope of the present invention.

Turning now to FIGS. 8-11, in this configuration in which a the plurality of wall segments 102*a*, 102*b*, 102*c* are provide in a side-by-side fashion, multiple shelf fixtures 136 and/or light box fixtures 138 may be similarly mounted in a side-by-side fashion (not shown). In doing so the one or more of the tabs 150 from each arm 140, 140 of the multiple fixtures 136, 138 are inserted into a slot 128 in the corresponding support rail 104, 106. The slots 128 are of sufficient size as to accommodate the tabs 150 of two adjacently positioned shelf fixtures 136, 138 simultaneously within the same slot 128. That is to say, when two fixtures 136, 138 are positioned in a side-by-side fashion at the same height, the tabs 150 of their adjacent arms 140, 142 will be retained within the same slot 128. As such the slots 128 are at least twice as wide as the tabs 150, as to accommodate two tabs 150 to be simultaneously received in any given slot 128.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It is also understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. An illuminated shelf system, comprising:

a first support rail and a second support rail, the first support rail comprising first and second edge retaining slots configured to receive edges of respective wall panels, and the second support rail comprising third and fourth edge retaining slots configured to receive edges of respective wall panels;

a wall panel disposed between the first support rail and second support rail, the wall panel comprising a first edge received by the first edge retaining slot of the first support rail, and a second edge received by the third edge retaining slot of the second support rail;

a first electrical supply rail and second electrical supply rail affixed to a front surface of the wall panel and insulated from the first support rail and second support rail;

at least one fixture removably mounted to the first support rail and second support rail, the at least one fixture including a first arm at a first lateral edge of the fixture, and a second arm at a second lateral edge of the fixture;

an array of light emitting diodes disposed within the at least one fixture and extending approximately from the first arm to the second arm, wherein a first end of the array of light emitting diodes is in removable electrical contact with the first electrical supply rail via a first conductor extending from the first end of the array to a first electrical contact surface in contact with the first electrical supply rail, and wherein a second end of the array of light emitting diodes is in removable electrical contact with the second electrical supply rail via a second conductor extending from the second end of the array of light emitting diodes to a second electrical contact surface in contact with the second electrical supply rail; and a power supply in electrical contact with the first electrical supply rail and second electrical supply rail as to define an electrical circuit and configured to provide an electrical current to the array of light emitting diodes when the least one fixture is mounted to the first support rail and second support rail.

2. The illuminated shelf system of claim 1, wherein the power supply is a low voltage power supply.

3. The illuminated shelf system of claim 1, where the electrical current in the circuit is provided via the power supply having a voltage less than or equal to approximately 24 volts.

4. The illuminated shelf system of claim 1 further comprising a third support rail and a second wall panel disposed between the second support rail and third support rail.

5. The illuminated shelf system of claim 4 further comprising a fourth support rail and a third wall panel disposed between the third support rail and fourth support rail.

6. The illuminated shelf system of claim 1, comprising a first channel and a second channel disposed in the front surface of the wall panel wherein the first electrical supply rail is disposed within the first channel and the second electrical supply rail is disposed within the second channel.

7. The illuminated shelf system of claim 6, wherein a portion of the first and second electrical supply rails extends outwardly from the front surface of the wall panel.

8. The illuminated shelf system of claim 7, wherein the at least one fixture includes a first resilient electrical contact surface that is in electrical contact with the first end of the light emitting diode array and configured to form an electrical connection with the first electrical supply rail, and wherein the at least one fixture includes a second resilient electrical contact surface that is in electrical contact with the second end of the light emitting diode array and configured to form an electrical connection with the second electrical supply rail.

9. The illuminated shelf system of claim 1, wherein the first arm and second arm include a plurality of tabs configured to he received within a plurality of support slots in the first support rail and the second support rail respectively.

10. The illuminated shelf system of claim 9, wherein the fixture is a shelf having an upper surface and a lower surface, and wherein the upper surface of the shelf is configured to support products and the array of light emitting diodes is configured to illuminate an area below the lower surface of the shelf.

11. The illuminated shelf system of claim 9, wherein the fixture is a light box having an front surface substantially parallel to the front surface of the wall panel, and wherein the array of light emitting diodes is configured to illuminate the front surface of the light box.

12. The illuminated shelf system of claim 9, wherein the support slots in the first support rail and the second support rail have a width at least twice as long as a width of the tabs configured to be received therein.

13. The illuminated shelf system of claim 12, wherein each support slot in the first support rail and the second support rail is configured to concurrently receive two tabs therein.

14. An illuminated shelf system, comprising:

a first support rail, a second support rail, a third support rail, and a fourth support rail, the first support rail comprising a first edge retaining slot, the second support rail comprising second and third edge retaining slots, the third support rail comprising fourth and fifth edge retaining slots, and the fourth support rail comprising a sixth edge retaining slot;

a first wall panel disposed between the first support rail and second support rail, the first wall panel comprising edges respectively received by the first and second edge retaining slots;

a second wall panel disposed between the second support rail and third support rail, the second wall panel comprising edges respectively received by the third and fourth edge retaining slots;

a third wall panel disposed between the third support rail and fourth support rail, the third wall panel comprising edges respectively received by the fifth and sixth edge retaining slots;

each of the wall panels having a first electrical supply rail and second electrical supply rail disposed within a front surface of the wall panel and electrically insulated from the support rails;

at least one shelf removably mounted to the support rails, the at least one shelf including a first arm at a first lateral edge of the shelf, and a second arm at a second lateral edge of the shelf;

an array of light emitting diodes disposed within the at least one shelf and extending approximately from the first arm to the second arm, wherein a first end of the array of light emitting diodes is in removable electrical contact with the first electrical supply rail via a first conductor extending from the first end of the array to a first electrical contact surface in contact with the first electrical supply rail, and wherein a second end of the array of light emitting diodes is in removable electrical contact with the second electrical supply rail via a second conductor extending from the second end of the array of light emitting diodes to a second electrical contact surface in contact with the second electrical supply rail; and a low voltage power supply electrically connected to the first electrical supply rail and second electrical supply rail as to define an electrical circuit configured to provide an electrical current to the array of light emitting diodes when the least one shelf is mounted to the support rails, the low voltage power supply having a voltage of less than or equal to approximately 24 volts.

15. The illuminated shelf system of claim 14, wherein the support rails include a plurality of support slots, wherein each support slot is configured to receive therein at least a portion of a first shelf and second shelf therein, when the first and second shelves are removably mounted to the support rails.

16. The illuminated shelf system of claim 14, wherein each wall panel further comprises a first channel and a second channel disposed in the front surface of the wall panel, and wherein the first electrical supply rail is disposed within the first channel and the second electrical supply rail is disposed within the second channel.

17. The illuminated shelf system of claim 16, wherein a portion of the first and second electrical supply rails extend outwardly from the front surface of the wall panel.

* * * * *